US005472361A

United States Patent [19]

Fujimoto et al.

[11] Patent Number: 5,472,361

[45] Date of Patent: Dec. 5, 1995

[54] MARINE PROPULSION UNIT

[75] Inventors: Hiroaki Fujimoto; Akihiro Onoue, both of Hamamatsu, Japan

[73] Assignee: Sanshin Kogyo Kabushiki Kaisha, Hamamatsu, Japan

[21] Appl. No.: 259,571

[22] Filed: Jun. 14, 1994

Related U.S. Application Data

[63] Continuation of Ser. No. 53,166, Apr. 27, 1993, abandoned.

[30] Foreign Application Priority Data

May 18, 1992 [JP] Japan ..... 4-148977

[51] Int. Cl.[6] ..... B63H 21/32

[52] U.S. Cl. ..... 440/89; 440/900

[58] Field of Search ..... 440/53, 58–63, 440/75–78, 900; 123/195 P

[56] References Cited

U.S. PATENT DOCUMENTS

| | | | |
|---|---|---|---|
| 2,900,947 | 8/1959 | Cotal | 440/58 |
| 3,195,521 | 7/1965 | Larsen | 440/900 |
| 3,911,853 | 10/1975 | Strang | 440/89 |
| 4,371,348 | 2/1983 | Blanchard | 440/77 |
| 4,449,945 | 5/1984 | Ferguson | 440/900 |
| 4,927,392 | 5/1990 | Makihara et al. | 440/77 |

*Primary Examiner*—Edwin L. Swinehart
*Attorney, Agent, or Firm*—Knobbe, Martens, Olson & Bear

[57] ABSTRACT

An improved outboard motor construction having a power head which has a water tight lower portion which is submerged when the associated watercraft is not in a planing condition so as to provide a buoyant assist for the watercraft to reach the planing condition without any attended hydrodynamic drag when planing.

10 Claims, 4 Drawing Sheets

MARINE PROPULSION UNIT

This application is a continuation of application Ser. No. 08/053,166, filed Apr. 27, 1993 now abandoned.

BACKGROUND OF THE INVENTION

This invention relates to a marine propulsion unit and more particularly to an improved outboard motor construction that assists in bringing the associated watercraft into a planing condition.

It is well known that a wide variety of outboard motors have been proposed which are mounted on the transom of an associated watercraft and which operate to propel the watercraft. The most commonly utilized type of watercraft hull propelled by outboard motors is a so-called planing type of hull. With this type of hull, at low speeds the hull becomes relatively deeply submerged but as the boat approaches its planing speed, it will move upwardly so as to substantially reduce the amount of water which the hull displaces. However, when accelerating the weight of the outboard motor on the transom tends to cause the transom to move downwardly and the bow move upwardly so as to increase the resistance to reaching the planing condition. The only way the watercraft can then be moved into the planing condition is to either increase the amount of power or to employ some kind of a plate or dynamic lift device at the stern of the boat or at the rear of the marine propulsion unit so as to arrive in the planing condition.

It is, therefore, a principal object of this invention to provide an improved marine propulsion unit that will assist in achieving planing of the associated watercraft but which will not afford significant restriction when traveling at high speeds.

The prior art type of dynamic lift devices have provided a drag that reduces the high speed operation. It is, therefore, a still further object of this invention to provide an improved outboard motor construction which will provide a buoyant lift for the transom of the watercraft when traveling at low speeds but which will be out of the water and afford no drag when reaching the planing condition.

SUMMARY OF THE INVENTION

This invention is adapted to be embodied in an outboard motor for attachment to the transom of a hull of an associated watercraft for powering the watercraft. The outboard motor is comprised of a power head consisting of a powering internal combustion engine and a surrounding protective cowling. A lower unit depends from the power head and contains a propulsion device that is powered by the internal combustion engine for providing a propulsion thrust to the associated watercraft. At least the lower portion of the power head is water tight and buoyant. Means are provided for mounting the outboard motor on the transom with the lower portion of the power head being at least partially submerged when the watercraft is not in a planing condition and completely out of the water when the watercraft is in a planing condition.

DETAILED DESCRIPTION OF THE PREFERRED EMBODIMENT OF THE INVENTION

Figure 1:
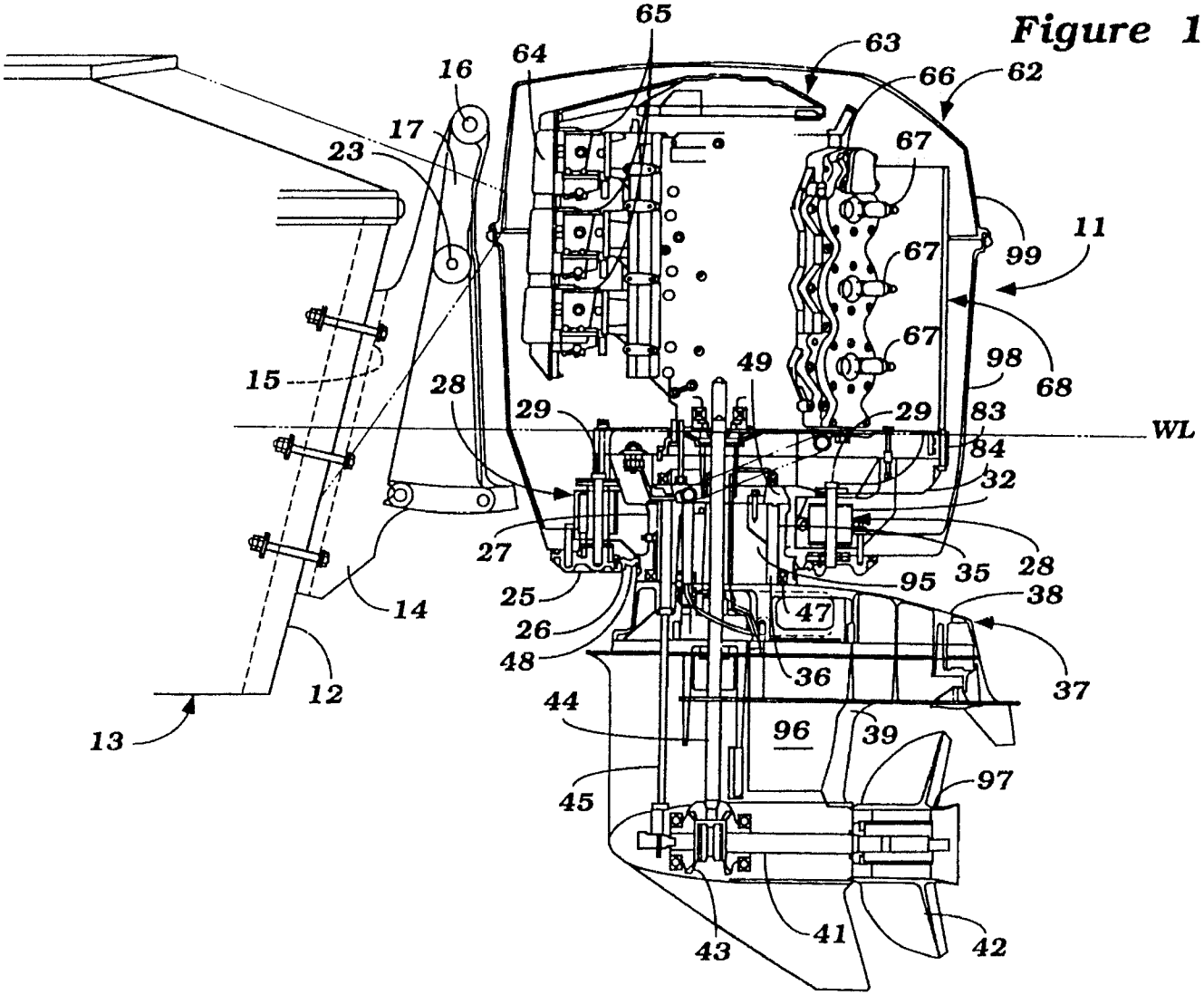
FIG. 1 is a side elevational view of the rear portion of a watercraft and powering outboard motor constructed in accordance with an embodiment of the invention, with portions broken away and other portions shown in section.

Referring now in detail to the drawings and initially, primarily to FIG. 1, an outboard motor constructed in accordance with an embodiment of the invention is identified generally by the reference numeral 11 and is depicted as being attached, in a manner to be described, to a transom 12 of an associated watercraft, shown partially and identified generally by the reference numeral 13.

Figure 2:
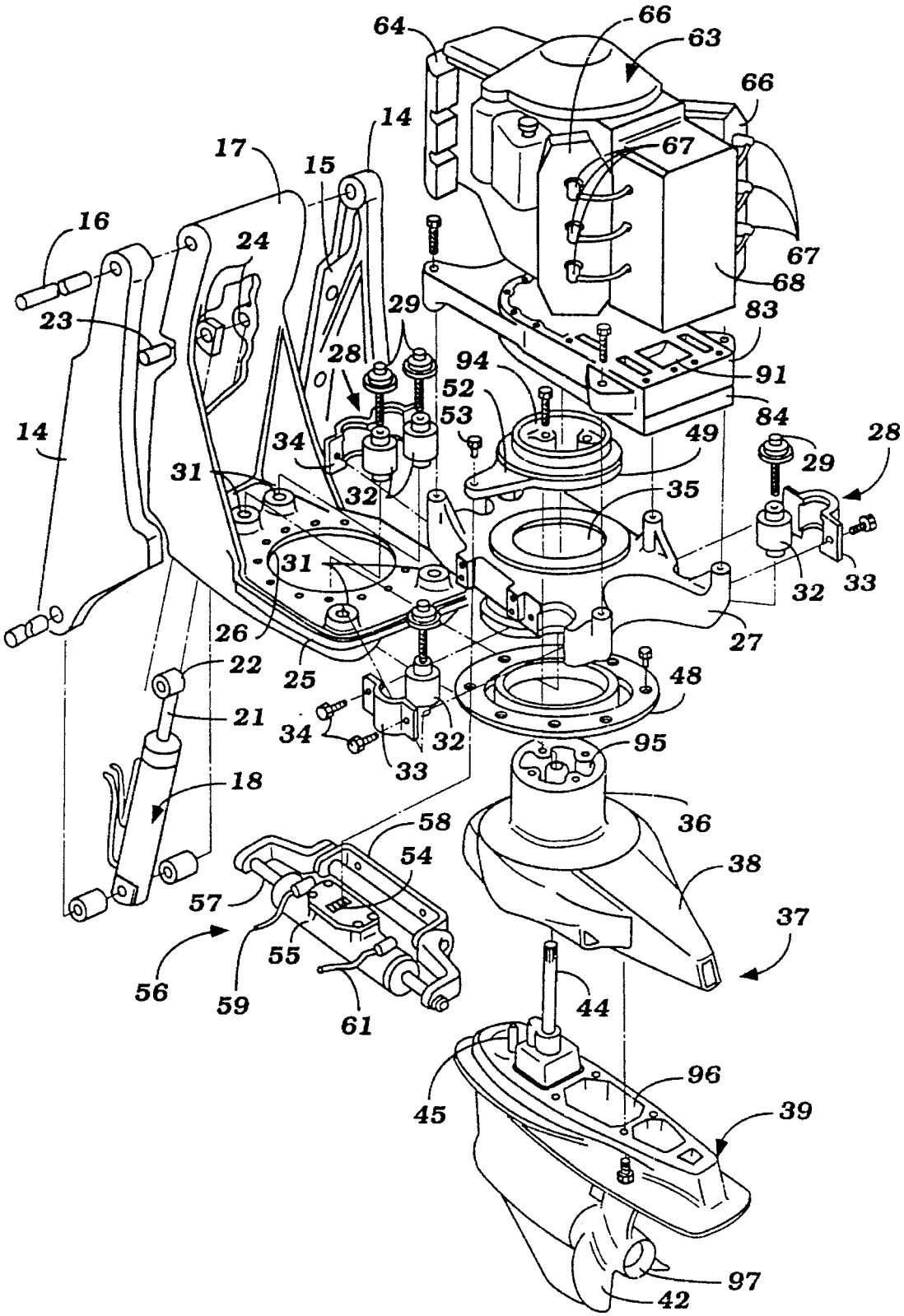
FIG. 2 is an enlarged exploded perspective view of the outboard motor, with the protective cowling removed to more clearly show the construction.

Referring now additionally to FIG. 2, the attachment arrangement for connecting the outboard motor 11 to the transom 12 includes a clamping plate assembly 14 that is comprised of a pair of spaced apart plates which have flanges 15 that are affixed to the transom 12 in a well known manner. The upper ends of the plates 14 carry pivot pins 16 which, in turn, support a supporting cradle 17 for pivotal movement about a horizontally disposed axis for tilt and trim operation. A hydraulic cylinder assembly 18 has its cylinder portion affixed for pivotal movement to the clamping brackets 14 by pivot pins 19. A piston rod 21 of the cylinder assembly 18 has a trunnion portion 22 that is pivotally connected to the cradle 17 by means of a pivot pin 23. This pivot pin 23 is received in a pair of spaced apart lugs 24 of an upstanding portion of the cradle 17. The hydraulic motor 18 may include a shock absorbing mechanism so as to permit the outboard motor 11 to pop up when an underwater obstacle is struck. In addition, the hydraulic motor assembly 18 may be energized by a suitable power source and valving arrangement for achieving tilt and trim movement of the outboard motor 11.

The cradle 17 has a generally horizontally disposed portion 25 in which an opening 26 is formed. The portion 25 is disposed so that it will be lower than the water level "WL" as indicated by the dot dash line in FIG. 1 and by the lines in FIGS. 5 and 6 when the associated watercraft 13 is in a non-planing condition. The reason for this will be readily apparent as the description proceeds. However, when the watercraft reaches a planing condition (FIG. 6) then the horizontal portion 25 of the cradle 17 will be positioned well above the water level.

A supporting plate 27 is resiliently mounted on the cradle 17 and specifically the horizontally extending portion 25 by means of a plurality of elastic isolators, indicated generally by the reference numeral 28. The elastic isolators 28 include fastening bolts 29 that are received in tapped holes formed in bosses 31 formed at spaced locations around the horizontal portion opening 26. Elastic bushings 32 are received around the threaded fasteners 29 and are held in place to the supporting plate 27 by means of clamp assemblies 33 which are, in turn, held in place by threaded fasteners 34. As a result of this mounting arrangement, the supporting plate 27 is elastically mounted on the cradle 17 so as to dampen vibrations transmitted to the cradle 17 from the propulsion device, to be described.

The supporting plate 27 is formed with a cylindrical opening 35 into which a cylindrical portion 36 of a lower unit assembly, indicated generally by the reference numeral 37 extends and is journalled. The lower unit assembly includes an upper portion 38 which may be formed from a light weight alloy casting such as aluminum or aluminum alloy and on which the cylindrical portion 36 is formed. The lower unit 37 further includes a lower assembly, indicated generally by the reference numeral 39.

A propeller shaft 41 is journaled within the lower unit housing 39 in a known manner and has a propeller 42 affixed to its outer end. A bevel gear type of reversing transmission 43 is associated with the propeller shaft 41 and it is driven by a vertically extending driveshaft 44 which is, in turn, driven, in a manner which will be described. The reversing transmission 43 selectively drives the propeller shaft 41 and propeller 42 in forward or reverse directions, as is well known in this art. A shift selector rod 45 is connected to a remote operator (not shown) in a suitable manner for shifting the transmission 43. The particular type of transmission 43 employed and its shift mechanism may be of any type known in the art.

The mounting plate 27 has a portion that extends through the opening 26 and a water tight seal 47 is interposed between the upper lower unit housing portion 36 and this depending portion so as to preclude against water leakage. In addition, a diaphragm type seal 48 is affixed to the cradle horizontal portion 25 and engages the depending portion of the mounting plate 27 so as to provide an effective water tight seal, for a reason to be described.

A steering ring 49 is affixed to the upper end of the cylindrical portion 36 of the lower unit 37 by means of threaded fasteners 51. The steering plate 49 is journaled on the upper surface of the mounting plate 27 and is provided with an outwardly extending steering arm 52. The steering arm 52 carries a pin 53 that is received in a complimentary slot 54 of a cylinder 55 of a hydraulic steering cylinder 56. The cylinder 55 has a bore in which a piston is received and this piston has a piston rod 57 that extends outwardly and which is affixed to a bracket 58 which is, in turn, affixed to the side of the mounting plate 27. A pair of hydraulic lines 59 and 61 extend to opposite sides of the cylinder assembly 55 and can be selectively pressurized and dumped under the operation of a control valve (not shown) so as to cause reciprocation of the cylinder housing 55 and rotation of the steering ring 49. This rotation is then transmitted to the lower unit 37 due to the aforedescribed connection and the propeller 42 will be rotated about a vertical steering axis, which axis is coincident with the axis of rotation of the driveshaft 44 so as to effect steering of the associated watercraft 13.

Disposed above the lower unit 37 and formed in part by the cradle 17 is a power head assembly, indicated generally by the reference numeral 62 and which power head assembly drives the driveshaft 41. This power head assembly 62 includes an internal combustion engine, indicated generally by the reference numeral 63 and which may be of any conventional type of construction, except for its exhaust system as will be hereinafter noted. In the illustrated embodiment, the engine 63 is depicted as being of the V6, two-cycle, crankcase compression type. As noted, however, the invention may be practiced with other types of engines.

The engine 63 includes an induction system comprised of an air intake device 64 that is disposed at the forward end of the power head 62 and which supplies atmospheric air to a plurality of charge formers in the form of carburetors 65. These carburetors 65 deliver the intake charge to the crankcase chambers of the engine 63 through an intake manifold which includes reed-type valves, as is well known in this art. This charge is then compressed in the crankcase chambers and delivered to the combustion chambers of the engine, formed in part by cylinder heads 66 which are affixed to the respective cylinder banks and which is fired by spark plugs 67 in a well known manner. The exhaust charge is then discharged through an exhaust manifold formed in the valley between the cylinder banks and is delivered to an exhaust silencing device, indicated generally by the reference numeral 68 and having a construction as best shown in FIGS. 3 and 4.

In conventional outboard motor construction, the exhaust silencing is achieved normally by an expansion chamber which is formed in the driveshaft housing. This has a number of disadvantages. First, in order to provide effective silencing the expansion chamber should have a substantial volume and when this expansion chamber is formed in the driveshaft housing, it will interfere with other components contained therein, such as the coolant supply for the engine, the driveshaft and bearings therefor, the water pump and various other components. Also, it is desirable to keep the configuration of the driveshaft housing as small and narrow as possible so as to reduce drag in the water. In accordance with the illustrated embodiment, the exhaust silencing device 68, which forms primarily an expansion chamber, is provided in the power head of the outboard motor.

Figure 4:
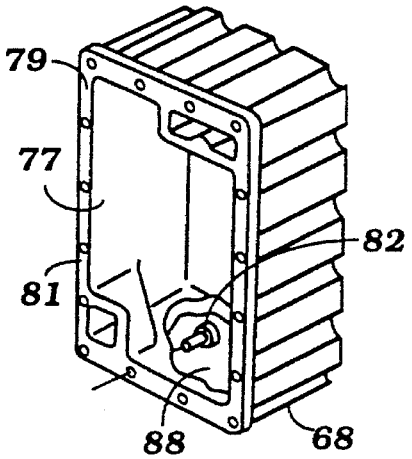
FIG. 4 is a perspective view looking in the direction of the arrow 4 in FIG. 3.
Figure 3:
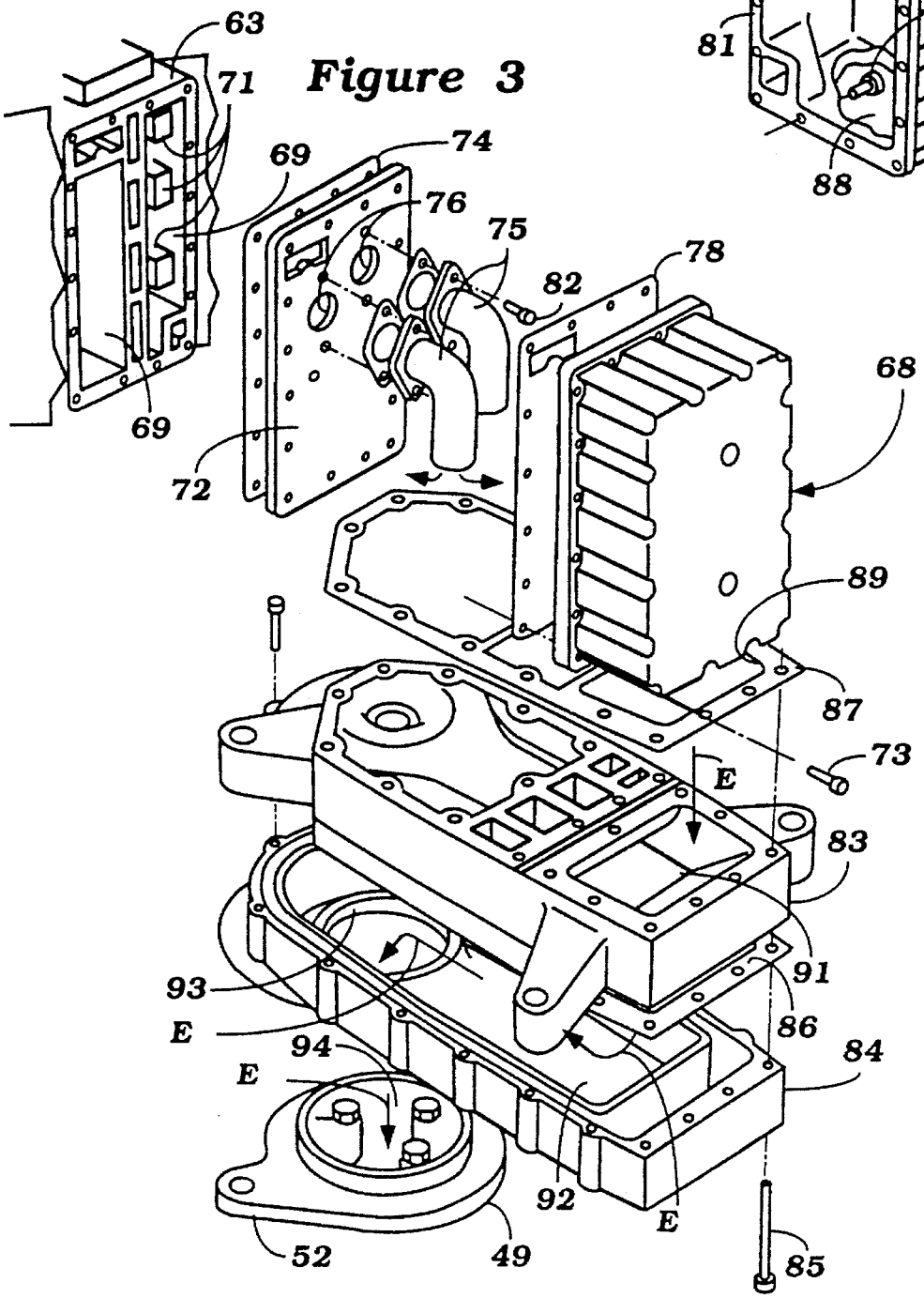
FIG. 3 is a still further enlarged exploded perspective view showing the exhaust silencing arrangement of the outboard motor.

Referring now specifically to FIGS. 3 and 4, as has been noted there are provided exhaust manifolds in the valley of the cylinder block of the engine. These exhaust manifolds are shown partially in FIG. 3 and are identified by the reference numeral 69. Exhaust gases are delivered to the exhaust manifold 69 from exhaust ports 71 formed in the cylinder liners and cylinders themselves, as is well known with this art.

A manifold closure plate 72 is affixed to the upper portion of the cylinder block to close the manifolds 69. Threaded fasteners 73 and a sealing gasket 74 complete the closure of the manifold 69.

A pair of exhaust pipes 75 are affixed to the closure plate 72 by fasteners 82 and register with respective openings 76 which permit the exhaust gases to flow from the exhaust manifold 69 into a hollow interior expansion chamber 71 formed by the silencing device 68. A further gasket 78 is interposed between a flange 79 of the exhaust silencing device and the manifold closure plate 72. The threaded fasteners 73 extend through the flange 81 and affix the silencing device 68, closure plate 72 and gasket 74 and 78 in position.

From the expansion chamber 77 the exhaust gases are discharged downwardly, as shown by the arrows "E" in FIG. 3 to a buoyant body consisting of an upper piece 83 and a lower piece 84 that are affixed to each other and to the underside of the engine 63 and exhaust silencing device 68 by means of a plurality of threaded fasteners 85. A sealing gasket 86 is interposed between the bodies 83 and 84 and a sealing gasket 87 is positioned between the body 83 and the underside of the cylinder block of the engine 63 and the exhaust silencing device 68.

The lower face of the exhaust silencing device 68 is provided with an exhaust discharge opening 88 which mates with a corresponding opening 89 in the gasket 87 and which registers with an exhaust passage 91 formed in the upper member 83. This exhaust passage 91 communicates with a hollow chamber 92, which forms a further expansion chamber between the pieces 83 and 84. The exhaust gases then exit through an opening 93 formed in the lower piece 84 which, in turn, registers with a hollow opening 94 in the steering member 49. The opening 94 permits the exhaust gases to flow downwardly into a further exhaust passage 95 formed in the upper part of the lower unit member 38 which, in turn, communicates with an exhaust discharge passageway 96 formed in the lower unit lower member 39. The exhaust passage 96 communicates with a through the hub underwater high speed propeller discharge 97.

As a result of the aforedescribed construction, it should be readily apparent that the exhaust gases are very effectively silenced by the expansion chamber silencing device 68 which is positioned in the power head and which is further silenced by flowing through the expansion chamber 92 of the buoyant body formed by the members 83 and 84 and through its underwater exhaust discharge. Also, since the exhaust gases have been effectively silenced and cooled in the power head, the lower unit 37 may be made quite compact in size and can have very low flow resistance.

Referring again to the construction of the power head 62, in addition to the internal combustion engine 63 and buoyant body formed by the plates 83 and 84, there is provided a protective cowling which sealingly surrounds the engine 63 and is affixed to the support cradle 17 so as to provide a water tight seal, at least around the lower portion thereof. This protective cowling is comprised of a lower tray member 98 which has a generally cupped shaped configuration and which is affixed in a suitable sealing manner to the portion 25 of the cradle 17 and which extends upwardly. A cover piece 99 is detachably affixed to the tray 98 in a known manner and completes the enclosure for the engine 63. Of course, a suitable atmospheric air inlet is provided by the cowling above the water level "WL" so that air for the engine induction may be drawn into the cowling.

Figure 6:
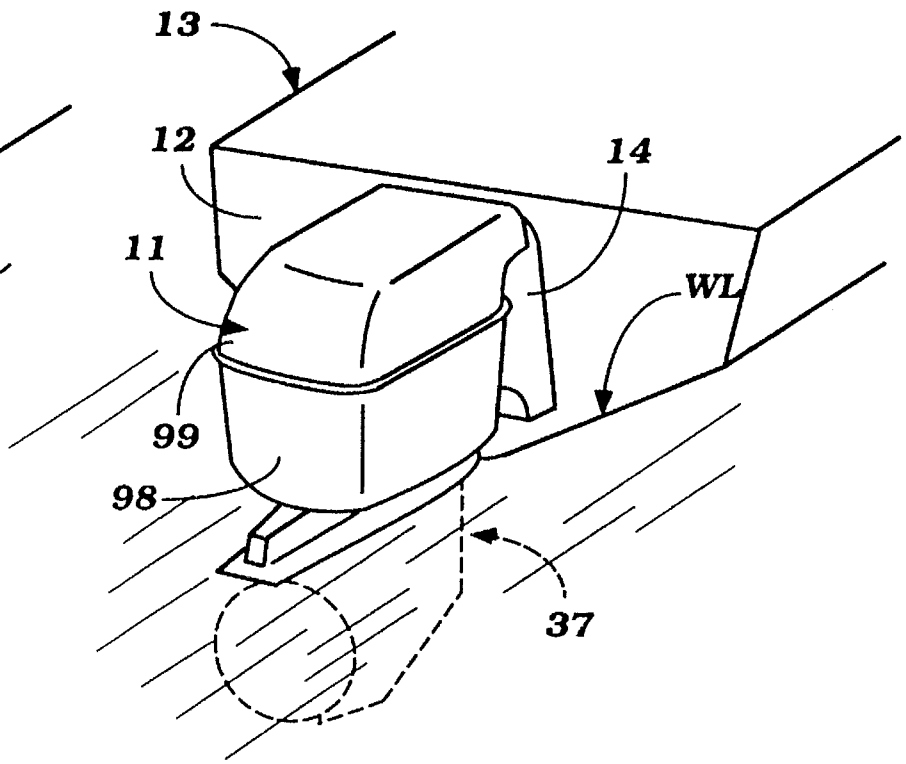
FIG. 6 is a rear perspective view, in part similar to FIG. 5, and shows the arrangement once it is in the planing condition.
Figure 5:
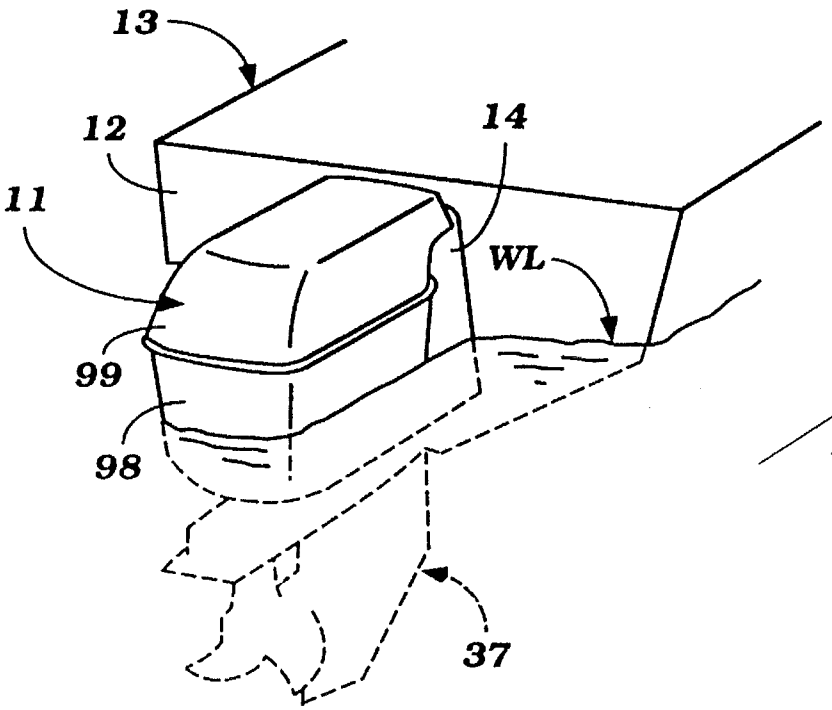
FIG. 5 is a rear perspective view showing the watercraft and attached outboard motor when in the non-planing condition.

As may be seen in FIGS. 1 and 5, when the associated watercraft 13 is operating in a non-planing condition, the water line "WL" will extend above not only the cradle portion 25 but also above the buoyant body formed by the plates 83 and 84 and around the protective cowling portion 98. As a result, there will be a buoyant lift to the rear of the hull 13 that will assist in the watercraft achieving the planing condition, as shown in FIG. 6. When the watercraft is planing, then only the lower unit 37 is submerged and then only partially so as to reduce the hydrodynamic drag.

Thus, the described construction provides a very effective way in which the watercraft can be brought into the planing condition without requiring hydrodynamic devices which will increase drag when running at high speed. Of course, the foregoing description is that of a preferred embodiment of the invention and various changes and modifications may be made without departing from the spirit and scope of the invention, as defined by the appended claims.

What is claimed is:

1. An outboard motor for attachment to the transom of a hull of an associated watercraft for powering said watercraft, said outboard motor being comprised of a power head comprised of a powering internal combustion engine having at least one exhaust port and a surrounding protective cowling, a lower unit depending from said power head and carrying a propulsion device powered by said internal combustion engine for providing a propulsion thrust to the associated watercraft, at least the lower portion of said power head comprised of the lower portion of the protective cowling and a buoyant body contained within said protective cowling and upon which said engine is mounted being water tight and buoyant, said buoyant body defining an expansion chamber volume to which exhaust gases are delivered from said engine exhaust port for silencing said exhaust gases and adding to the buoyancy of said buoyant body, and means for mounting said outboard motor upon said transom with said lower portion of said power head including the buoyant body but not said engine being at least partially submerged when said watercraft is in a body of water and not in a planing condition and completely out of the water when said watercraft is in planing condition.

2. An outboard motor as set forth in claim 1 wherein the surrounding protective cowling is at least partially submerged when the watercraft is in a body of water and is not planing and is water tight.

3. An outboard motor as set forth in claim 1 wherein the lower unit is supported for steering movement about a generally vertically extending steering axis relative to the internal combustion engine and seal means therebetween for maintaining the water tightness and buoyancy.

4. An outboard motor as set forth in claim 3 wherein the means for mounting the outboard motor upon the transom comprises a cradle having a pivotal connection to the associated watercraft for tilt and trim movement of the outboard motor.

5. An outboard motor as set forth in claim 4 wherein the pivotal axis is disposed adjacent the upper end of the power head.

6. An outboard motor as set forth in claim 5 wherein the buoyant mass is fixed to the cradle.

7. An outboard motor as set forth in claim 6 wherein the cradle has a horizontally extending portion with the buoyant body being mounted above the horizontally extending portion and the engine being mounted on the buoyant body.

8. An outboard motor as set forth in claim 7 wherein the buoyant body and the cradle horizontal portion are both below the water level when the watercraft is not planing.

9. An outboard motor as set forth in claim 1 wherein the expansion chamber volume of the buoyant body extends beneath the engine, the exhaust gases being delivered from the exhaust port to said expansion chamber volume at one end thereof and further including an exhaust gas discharge extending from the other end of said expansion chamber volume downwardly to the lower unit for discharging exhaust gases through said lower unit.

10. An outboard motor as set forth in claim 8 wherein the expansion chamber volume of the buoyant body extends beneath the engine, the exhaust gases being delivered from the exhaust port to said expansion chamber volume at one end thereof and further including an exhaust gas discharge extending from the other end of said expansion chamber volume downwardly to the lower unit for discharging exhaust gases through said lower unit.

* * * * *